US006651907B2

(12) United States Patent
Rodd

(10) Patent No.: US 6,651,907 B2
(45) Date of Patent: Nov. 25, 2003

(54) PORTABLE REFILLABLE WATER CONTAINER HAVING AN INTERIOR PUMP MEMBER

(76) Inventor: John W Rodd, 174 Chestnut St., Port Jefferson Station, NY (US) 11776

( * ) Notice: Subject to any disclaimer, the term of this patent is extended or adjusted under 35 U.S.C. 154(b) by 0 days.

(21) Appl. No.: 09/990,227

(22) Filed: Nov. 21, 2001

(65) Prior Publication Data

US 2003/0094511 A1 May 22, 2003

(51) Int. Cl.[7] ..... B05B 9/04
(52) U.S. Cl. ..... 239/332; 239/333; 239/329
(58) Field of Search ..... 239/332, 333, 239/302, 329

(56) References Cited

U.S. PATENT DOCUMENTS

| | | | | | |
|---|---|---|---|---|---|
| 4,801,088 | A | * | 1/1989 | Baker | 239/152 |
| 5,100,058 | A | * | 3/1992 | Wei | 239/273 |
| 5,303,866 | A | * | 4/1994 | Hawks, Jr. | 239/142 |
| 6,158,669 | A | * | 12/2000 | Louis | 239/146 |
| 6,179,224 | B1 | * | 1/2001 | Huesken | 239/152 |

* cited by examiner

*Primary Examiner*—Christopher Kim
(74) *Attorney, Agent, or Firm*—Michael I. Kroll

(57) ABSTRACT

The present invention 10 discloses a portable water container having a housing 22 with a fill cap 38 with a water valve 40 and means 44 within the housing for pumping the water 56 out of the housing 22. In addition, a vent 34 is also positioned within the housing opposite the fill cap 38. A handle 32, located at the top center portion of the device, allows for easy transporting of the container 22. A 12-volt plug 28 and coil cord 30 extends from the interior of the housing container having a connector 54 positioned on the exterior distal end providing means for connecting to a 12-volt power source 60. The other distal end of the cord is connected to a pump 44 that is used to selectively pump the liquid from the interior of the container 22. Also positioned within the housing 22 is a hose 46 connected at one distal end to the pump 44 and at the other to a fitting having a throughbore positioned within the wall of the container housing 22. The fitting has another length of hose 26 connected thereto having a spray nozzle 24 positioned on the other distal end whereby the contents of the container can be selectively discharged through the spray nozzle when the pump 44 is energized.

3 Claims, 11 Drawing Sheets

PORTABLE REFILLABLE WATER CONTAINER HAVING AN INTERIOR PUMP MEMBER

BACKGROUND OF THE INVENTION

Field of the Invention

The present invention relates generally to containers and more specifically to portable water containers having a housing with a fill cap with a water valve and means within the housing for pumping the water out of the housing. In addition, a vent is also positioned within the housing opposite the fill cap. A handle, located at the top center portion of the device, allows for easy transporting of the container. A 12-volt plug and coil cord extends from the interior of the housing container having a connector positioned on the exterior distal end providing means for connecting to a 12-volt power source. The other distal end of the cord is connected to a pump that is used to selectively pump the liquid from the interior of the container.

Also positioned within the housing is a hose connected at one distal end to the pump and at the other to a fitting having a throughbore positioned within the wall of the container housing. The fitting has another length of hose connected thereto having a spray nozzle positioned on the other distal end whereby the contents of the container can be selectively discharged through the spray nozzle when the pump is energized.

SUMMARY OF THE PRESENT INVENTION

The present invention discloses a portable water container having a housing with a fill cap with a water valve and means within the housing for pumping the water out of the housing. In addition, a vent is also positioned within the housing opposite the fill cap. A handle, located at the top center portion of the device, allows for easy transporting of the container. A 12-volt plug and coil cord extends from the interior of the housing container having a connector positioned on the exterior distal end providing means for connecting to a 12-volt power source. The other distal end of the cord is connected to a pump that is used to selectively pump the liquid from the interior of the container. Also positioned within the housing is a hose connected at one distal end to the pump and at the other to a fitting having a throughbore positioned within the wall of the container housing. The fitting has another length of hose connected thereto having a spray nozzle positioned on the other distal end whereby the contents of the container can be selectively discharged through the spray nozzle when the pump is energized.

A primary object of the present invention is to provide a portable refillable liquid container having an electric pump for selectively dispensing the contents of the container.

Another object of the present invention is to provide a portable refillable liquid container having an interiorly positioned pump for dispensing the contents of the container.

Yet another object of the present invention is to provide a portable refillable liquid container having an electrical connection member that can be plugged into any 12-volt power supply to power said pump.

Still yet another object of the present invention is to provide a portable refillable liquid container having a fill cap for selectively refilling the container.

Another object of the present invention is to provide a portable refillable liquid container having a detachable service panel providing access to the pump.

Yet another object of the present invention is to provide a portable refillable liquid container having a fitting with a throughbore positioned within the wall of the container.

Still yet another object of the present invention is to provide a portable refillable liquid container having an interiorly positioned conduit connecting the pump to the housing fitting.

Another object of the present invention is to provide a portable refillable liquid container having an exteriorly positioned flexible conduit having a spray nozzle connected to one distal end and the other connected to the housing fitting.

Yet another object of the present invention is to provide a water container consisting of a fill cap that provides a water valve to dispense water without the need of a 12 volt power source.

Still yet another object of the present invention is to provide a portable refillable container that provides an air vent located opposite the fill cap on the external portion of the portable container.

Another object of the present invention is to provide a portable refillable liquid container having a water valve to dispense water without the need of a 12 volt power source.

Additional objects of the present invention will appear as the description proceeds.

The present invention overcomes the shortcomings of the prior art by providing a portable refillable container having an exteriorly positioned flexible conduit with an adjustable spray nozzle and an interiorly positioned pump for selectively dispensing the contents of the container through the spray nozzle.

Additionally the portable refillable container has an exteriorly positioned electrical connection member whereby the pump can be powered by a 12-volt power source. Furthermore, the container has a removable service panel proving access to the interior components of the refillable container.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
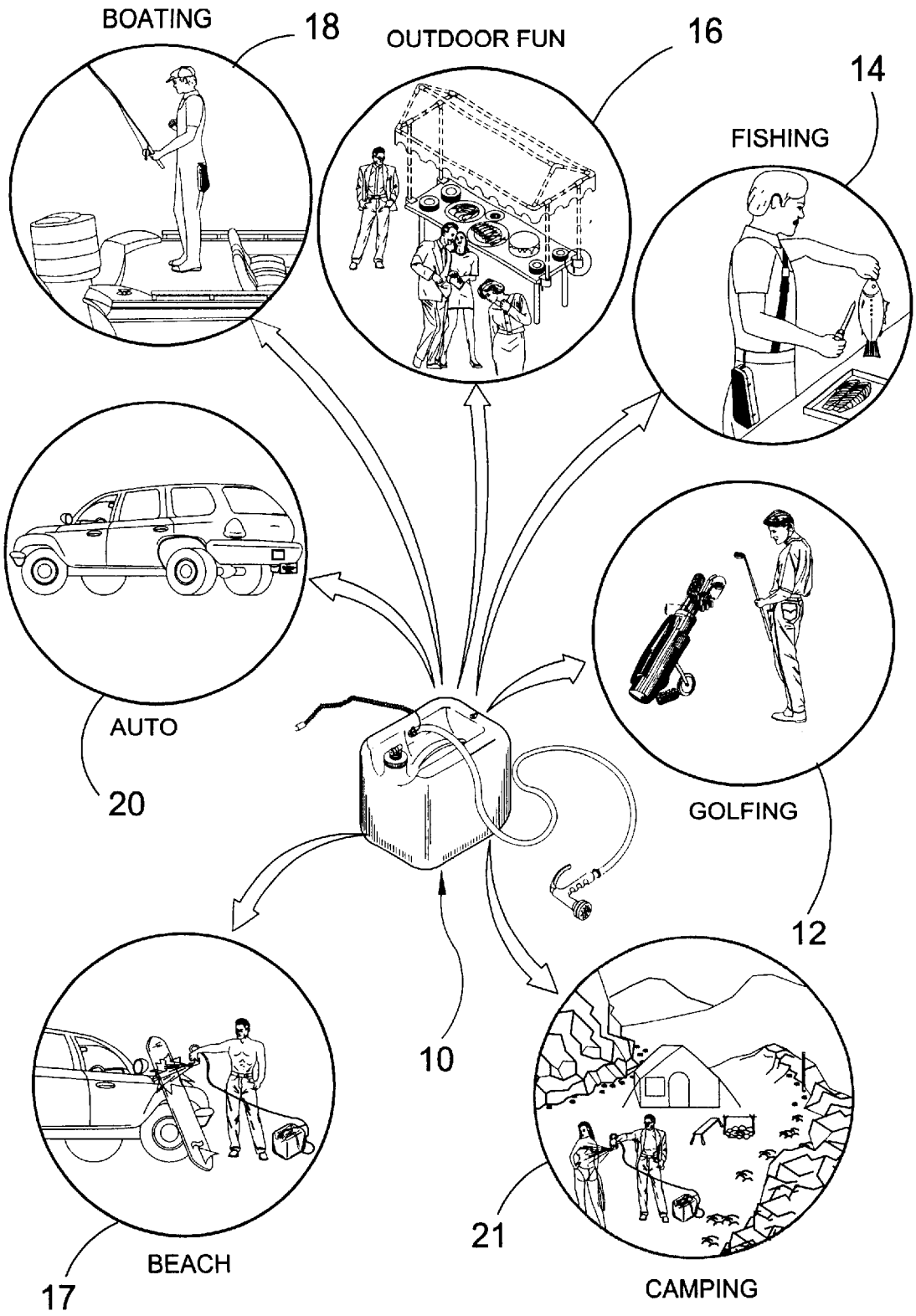
FIG. 1 is an illustrative view of the present invention in use.

With regard to reference numerals used, the following numbering is used throughout the drawings.

10 present invention
12 golfing
14 fishing
16 outdoor activities
17 surfboard
18 boating
20 auto
21 camping
22 water container
24 spray nozzle
26 hose
28 electrical plug
30 cord
32 handle
34 air vent
36 clamp
38 fill cap
40 water valve
42 deck lid
44 bilge pump
46 internal hose
48 internal hose clamp
50 wiring
52 opening for deck lid
54 plug connector
56 water
58 to nozzle
60 power port

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10 in use for golfing 12, fishing 14, outdoor activities 16, boating 18, and with a vehicle 20.

Figure 2:
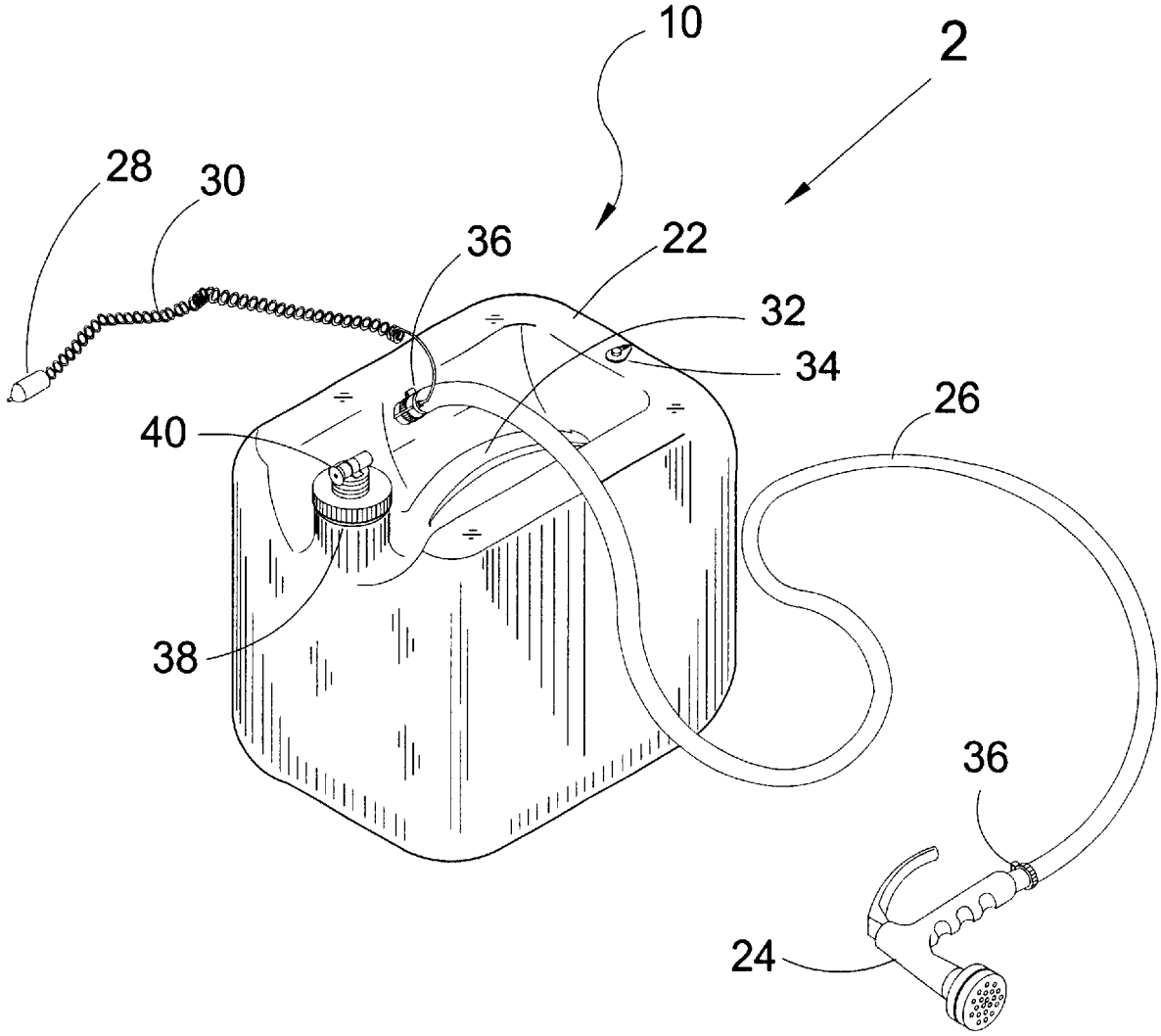
FIG. 2 is a perspective view of the present invention.

Turning to FIG. 2, shown therein is a perspective view of the present invention 10. The present invention, a portable water container 22, is plugged into a vehicle 12-volt port, allowing the user water at their disposal and a variety of different spray settings through the use of a variable setting spray nozzle 24. The device utilizes a small bilge pump that forces water through two feet of bilge pump hose and then through five feet of marine type hose 26 with clamps 36, connected at one distal end to the nozzle 24. The portable water container 22 with handle 32 and air vent 34 of the present invention is provided in a variety of sizes and holding capacities, providing versatile options for use and placement. The portable container provides a 12-volt plug 28 and coil cord 30 as a conduit to a 12-volt power source such as a car or boat 12-volt port, and must be powered by this source to function as intended. Also shown is fill cap 38 and water valve 40.

Figure 3:
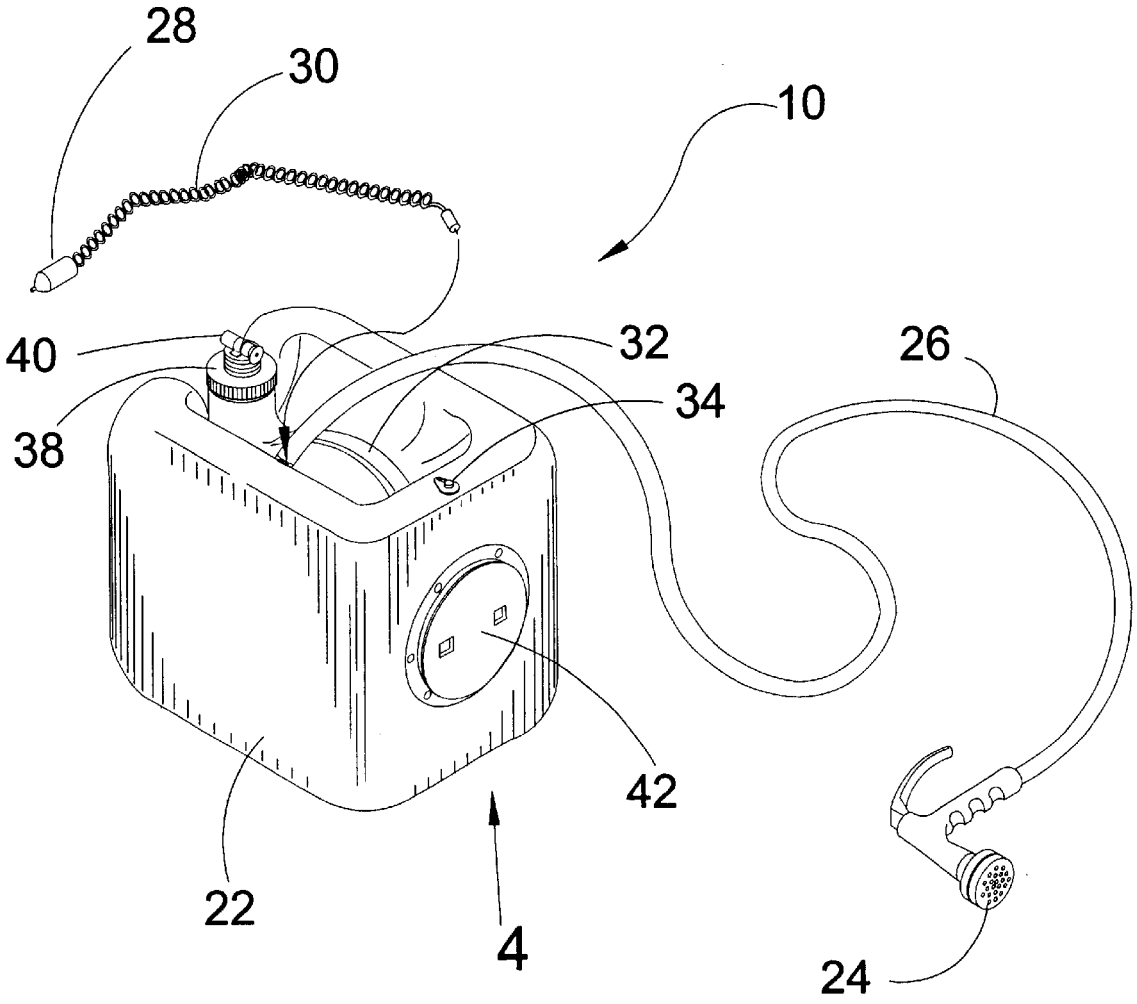
FIG. 3 is a rear view of the present invention.

Turning to FIG. 3, shown therein is a rear view of the present invention 10. The portable water container 22 of the present invention provides an easy fill cap 38 and water valve 40 located at the top portion of the housing 22 of the device that can be filled with hot or cold water. An air vent 34 is provided on the top rear portion of the housing 22. A screw on deck lid 42 is provided for easy access to the bilge pump, hose, hose connection and wiring housed within the container housing. Other elements previously disclosed are also shown.

Figure 4:
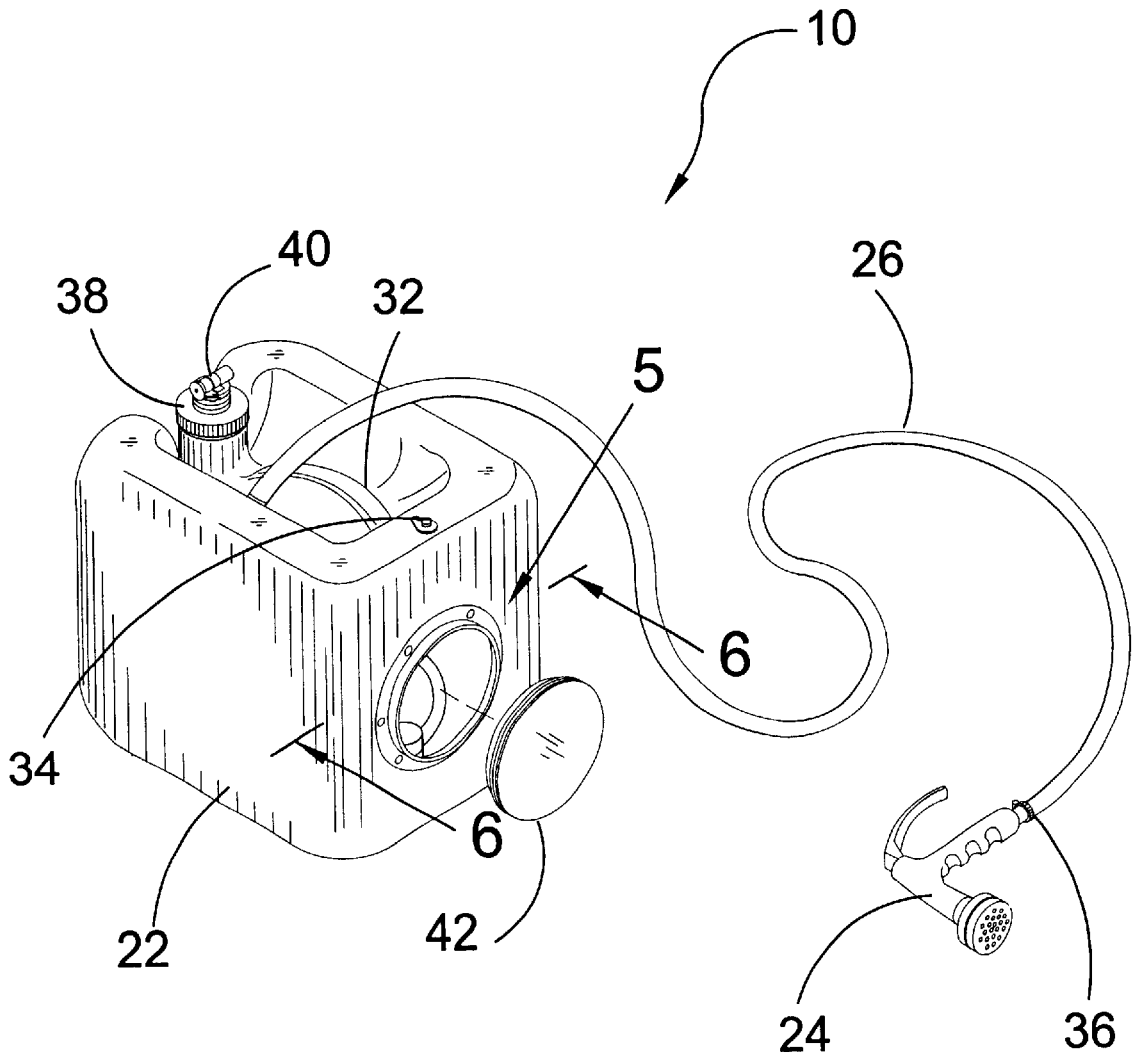
FIG. 4 is a rear perspective view of the present invention.

Turning to FIG. 4, shown therein is a rear perspective view of the present invention 10. The deck lid 42 of the present invention is removed to access the bilge pump, hose, hose connection and wiring housed within the container. The bilge pump forces water through two feet of internal bilge pump hose and then through five feet of external marine type hose 26 and connected to an adjustable spray nozzle 24. Other elements previously disclosed are also shown.

Figure 5:
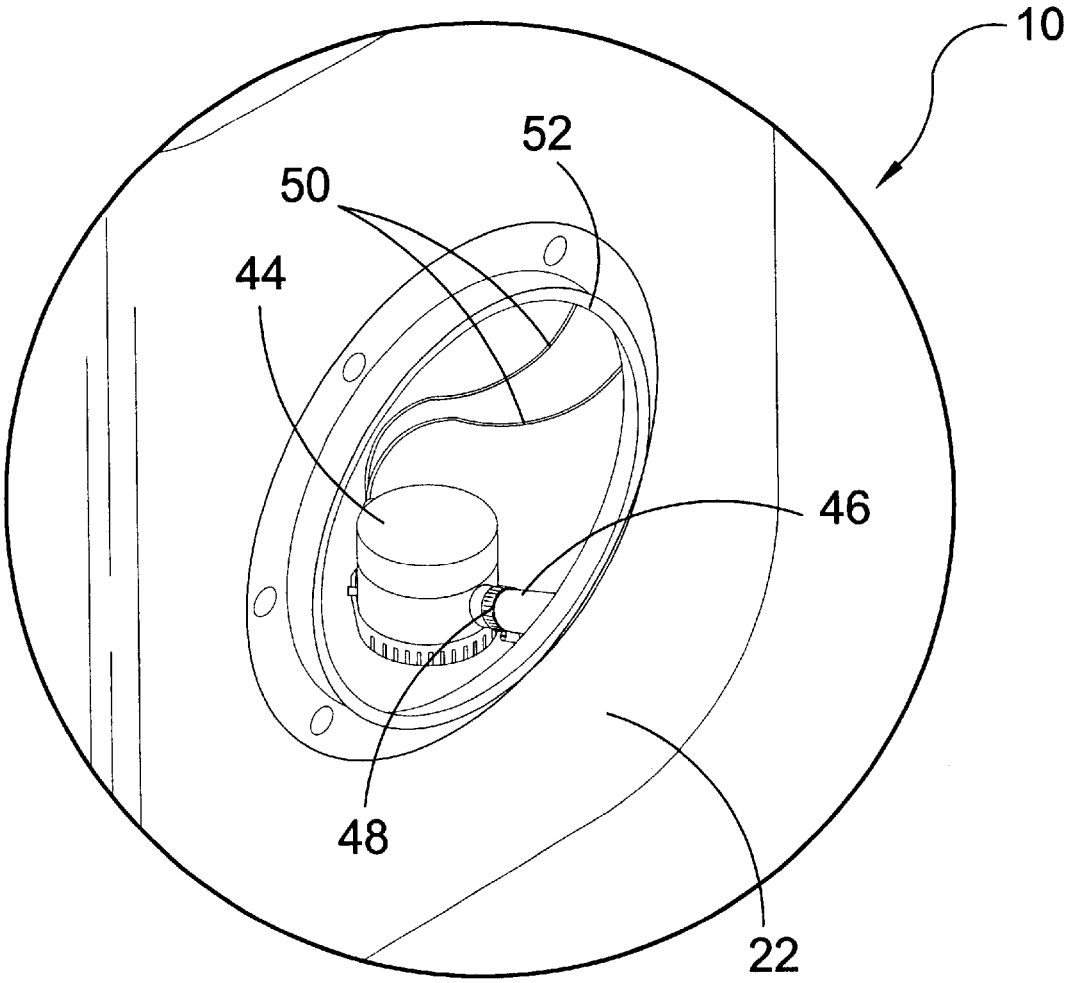
FIG. 5 is a detailed view of the present invention.

Turning to FIG. 5, shown therein is a detailed view of the present invention 10. The bilge pump 44 with wiring 50 of the present invention forces water through two feet of internal bilge pump hose 46 with clamp 48 and then through five feet of external marine type hose with an adjustable spray nozzle attached to its distal end. To access the bilge pump, the removal of the deck lid from the deck lid opening 52 of housing 22 is required.

Figure 6:
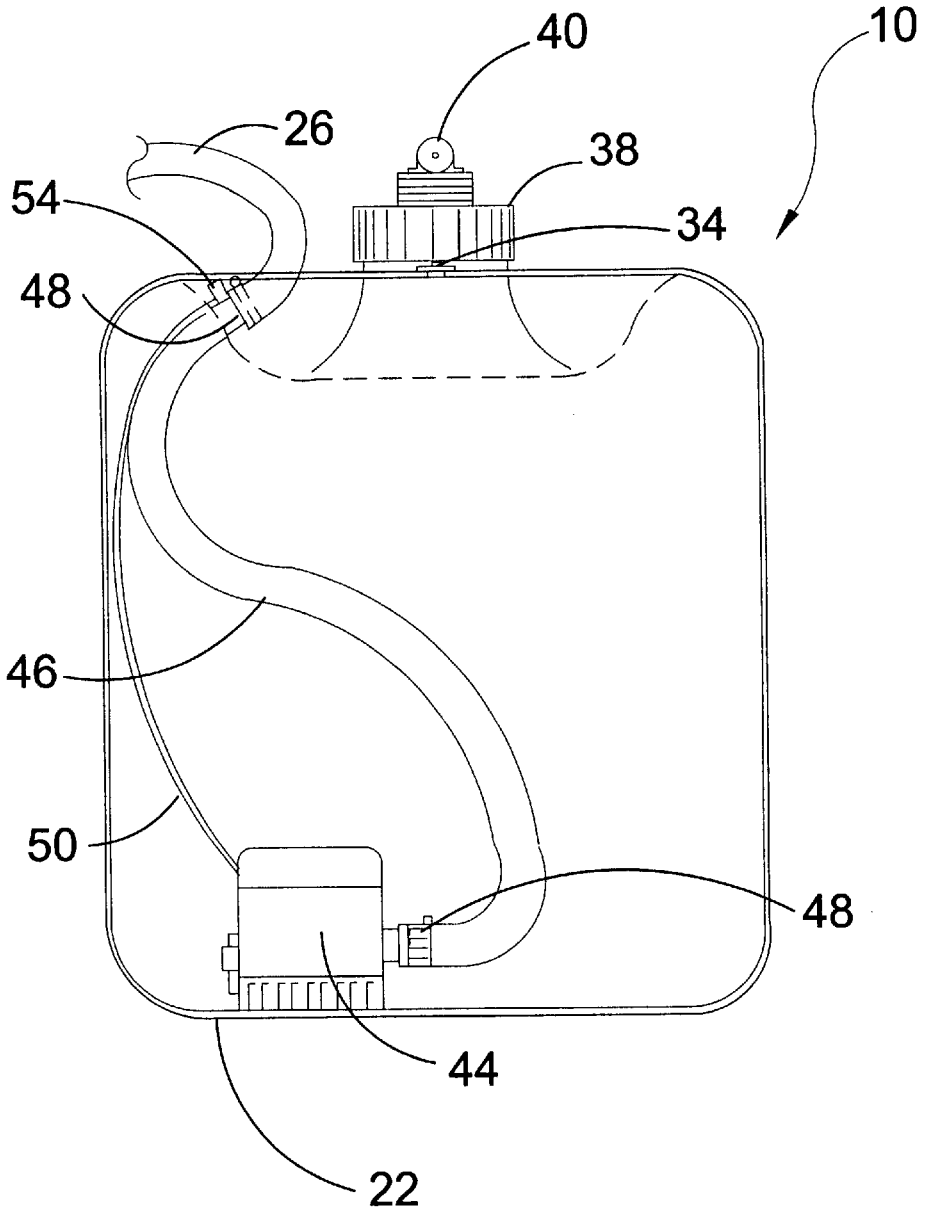
FIG. 6 is a sectional view of the present invention.

Turning to FIG. 6, shown therein is a sectional view of the present invention 10. The bilge pump 44 of the present invention forces water through two feet of internal bilge pump hose 46 with clamps 48 and plug connector 54 and then through five feet of external marine type hose 26 with an adjustable spray nozzle attached to its distal end. To access the bilge pump, 44 the removal of the deck lid is required. Other elements previously disclosed are also shown.

Figure 7:
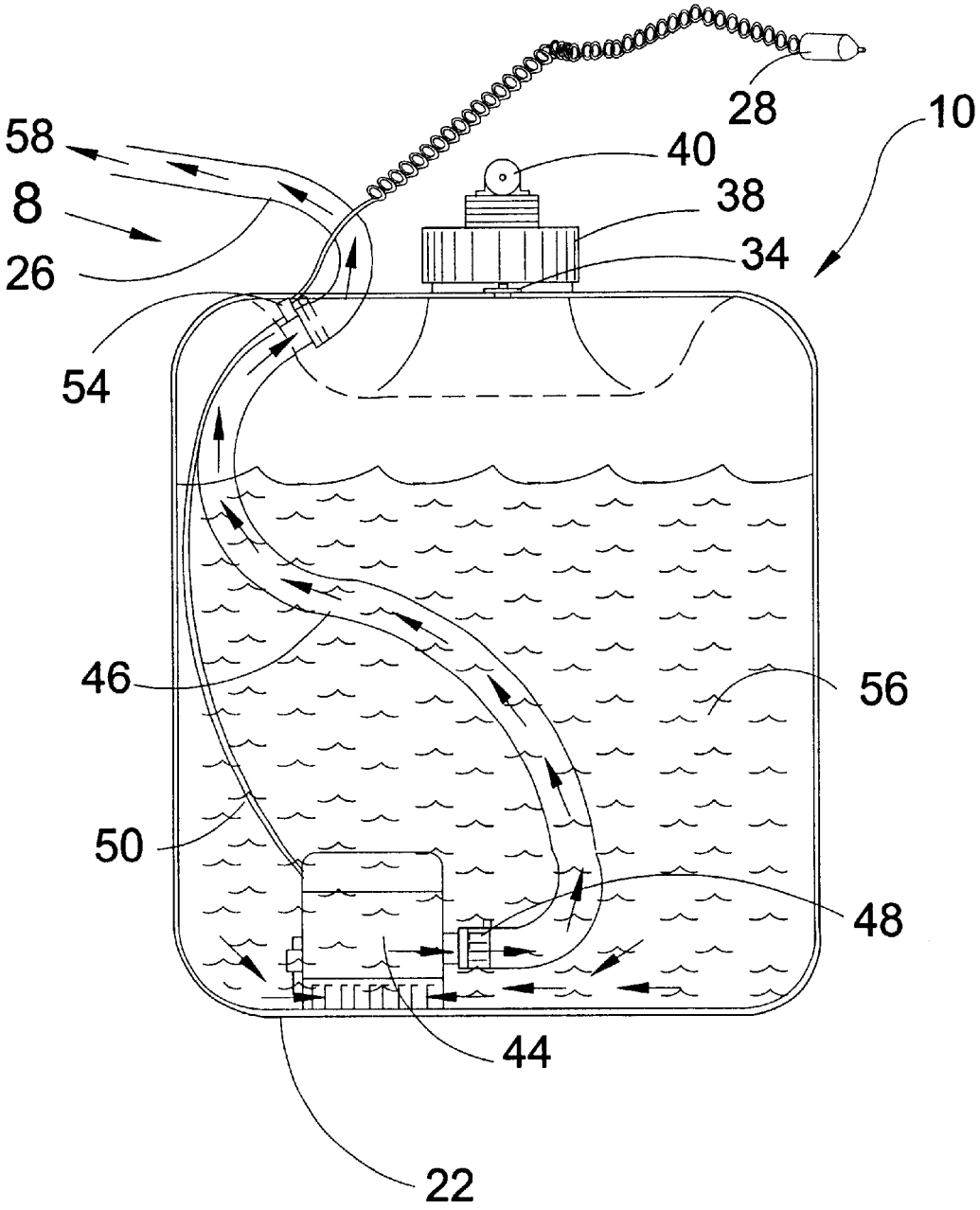
FIG. 7 is a sectional view of the present invention showing water flow path.

Turning to FIG. 7, shown therein is a sectional view of the present invention 10. The bilge pump 44 of the present invention forces water 56 through two feet of internal bilge pump 46 with clamps 48 and plug connector 54 and then through five feet of external marine type hose 26 leading to at 58 an adjustable spray nozzle attached to its distal end. To access the bilge pump 44, the removal of the deck lid is required. Other elements previously disclosed are also shown.

Figure 8:
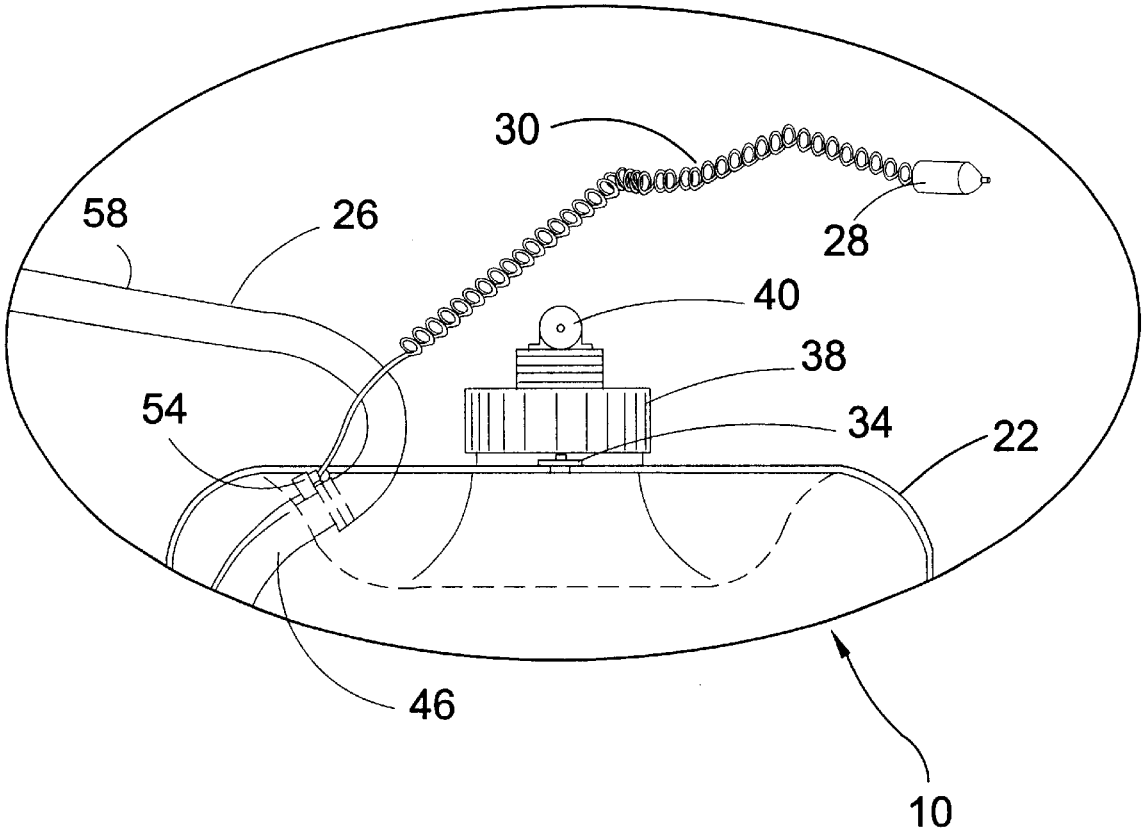
FIG. 8 is a detail view of the present invention.

Turning to FIG. 8, shown therein is a detail view of the present invention 10. The power connector 54 for the bilge pump is located along the hose 46 connection port on the external portion of the container 22. The coil cord 30 has a plug 28 that adapts to a 12-volt port. Other elements previously disclosed are also shown.

Figure 9:
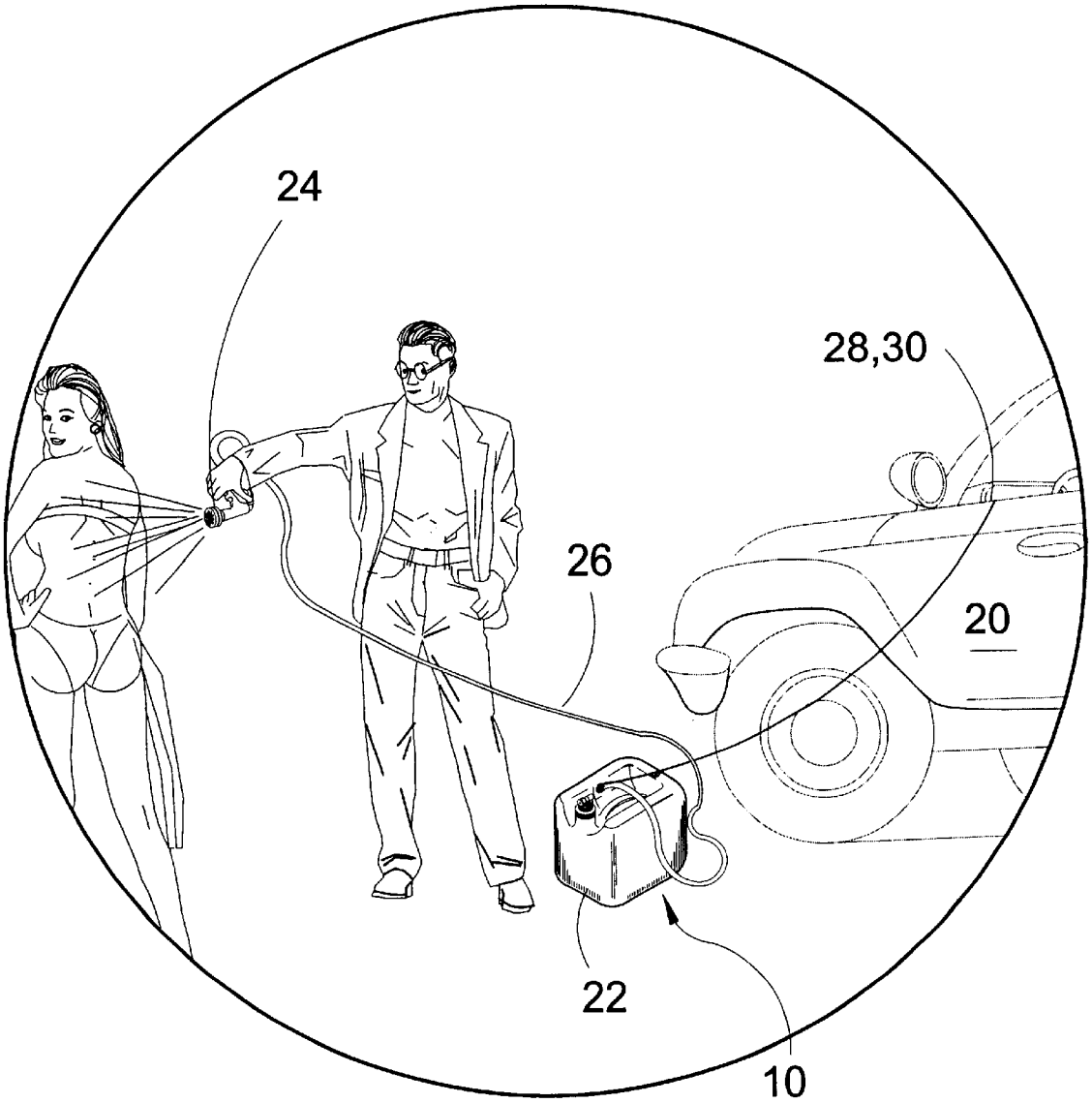
FIG. 9 is an illustrative view of the present invention in use.

Turning to FIG. 9, shown therein is an illustrative view of the present invention 10. Shown is the water container 22 of the present invention, attached to the 12-volt port of an automobile 20 as its power source. The present invention can be plugged into any 12-volt port such as equipped in cars, boats, trailers, campers and many other sources. Other elements previously disclosed are also shown.

Figure 10:
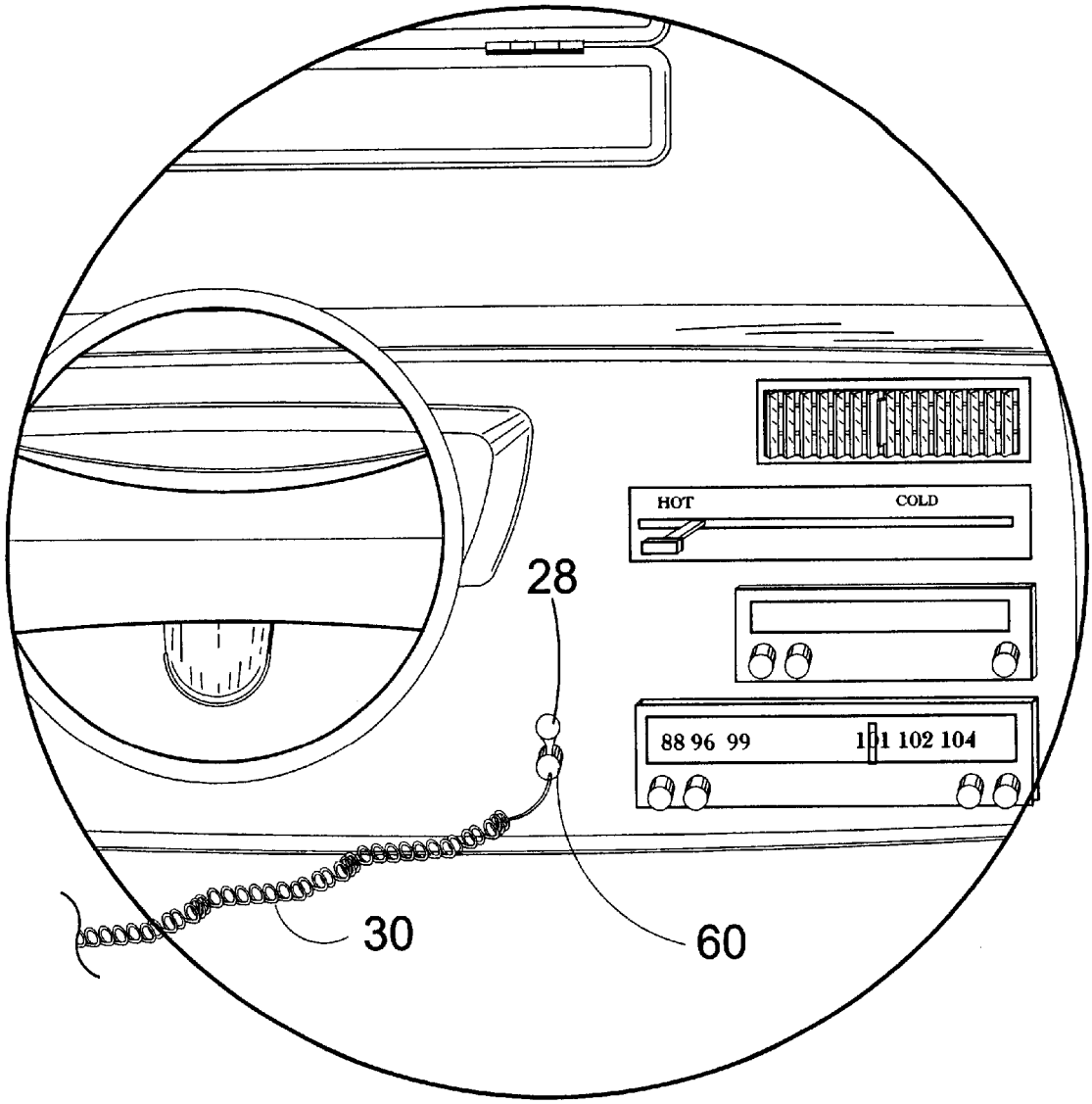
FIG. 10 is a detail view of the power connection of the present invention.

Turning to FIG. 10, shown therein is a detail view of the power connection of the present invention. Shown above is the 12-volt plug 28 and coil cord 30 plugged into a 12-volt power port source 60.

Figure 11:
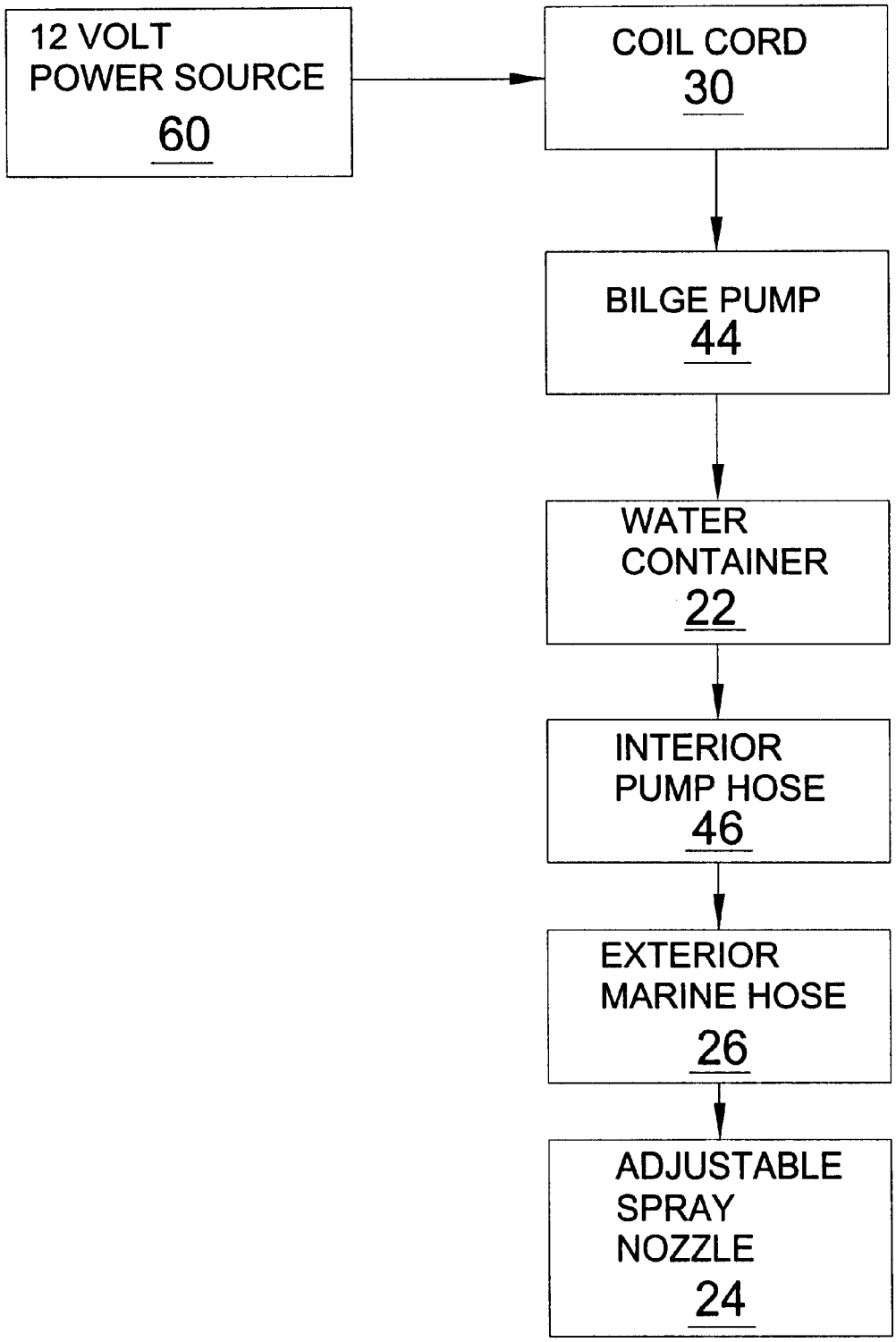
FIG. 11 is a block diagram of the present invention.

Turning to FIG. 11, shown therein is a block diagram of the present invention. The above block diagram shows the functional components of the present invention. Other elements previously disclosed are also shown.

What is claimed to be new and desired to be protected by Letters Patent is set forth in the appended claims:

1. An apparatus for a portable pressurized water supply, comprising:

a) an enclosed container, said container for holding water therein, said container having a top, a bottom and four sides wherein one of said sides has a threaded opening therein, and the top has each of a handle, fill cap and an air vent, a water valve being mounted on said fill cap;

b) means comprising a bilge pump for pumping water from the interior of said container whereby a pressurized water supply is provided, said bilge pump sitting on said bottom of said container immersed in water in said container and having a water inlet and a water outlet;

c) means for spraying water which is pumped from the interior of said container;

d) a power source for said bilge pump;

e) a mating, threaded deck lid for said opening on said side of said container for accessing the interior of said container;

f) an internal hose inside of said container having a first end and a second end, said first end being connected to said outlet of said bilge pump and said first end having a hose clamp thereon, said second end adjacent the top of said container;

g) an external hose disposed outside of said container, said external hose having a first end and a second end, said first end of said external hose being connected to said second end of said internal hose within said container, said first end of said external hose having a hose clamp thereon;

h) a power connector being located along said internal hose adjacent the second end thereof inside said container; and i) said power source comprising an electrical cord having one end connected to said power connector and another end terminating in a 12 volt plug for connection to a 12 volt power supply and electrical wires between said power connector and said bilge pump for delivering 12 volt electrical power to said bilge pump.

2. The apparatus of claim 1, wherein said external hose further comprises marine hose.

3. The apparatus of claim 2, wherein said means for spraying further comprises a spray nozzle disposed on said second end of said external hose.

* * * * *